US005637963A

United States Patent [19]

Inoue et al.

[11] Patent Number: 5,637,963

[45] Date of Patent: Jun. 10, 1997

[54] ELECTRODELESS LAMP HAVING A NARROW GAP BETWEEN A SEALED TUBE AND THE ARC CHAMBER SO AS TO FORM A CONSISTENT COLD SPOT

[75] Inventors: Akihiro Inoue; Akira Ito; Katsusuke Uchino; Shigehisa Kawatsuru, all of Kanagawa-ken, Japan

[73] Assignee: Toshiba Lighting & Technology Corporation, Tokyo, Japan

[21] Appl. No.: 401,683

[22] Filed: Mar. 10, 1995

[30] Foreign Application Priority Data

Mar. 11, 1994 [JP] Japan ..... 6-040959
Sep. 28, 1994 [JP] Japan ..... 6-233199

[51] Int. Cl.[6] ..... H05B 41/16

[52] U.S. Cl. ..... 315/248; 313/634

[58] Field of Search ..... 315/248; 313/634

[56] References Cited

U.S. PATENT DOCUMENTS 5,136,214 8/1992 Roberts et al. ..... 315/248

FOREIGN PATENT DOCUMENTS 489532 6/1992 European Pat. Off. ..... 315/248

*Primary Examiner*—Robert Pascal
*Assistant Examiner*—Michael Shingleton
*Attorney, Agent, or Firm*—Cushman Darby & Cushman, L.L.P.

[57] ABSTRACT

An electrodeless high intensity discharge lamp has a light transmissive ceramic arc tube for containing a discharge sustaining medium and a hollow tube member. An excitation coil for causing an arc discharge is situated about the arc tube. The ceramic arc tube includes a first portion for developing the arc discharge therein and a second portion protruding outwardly from the first portion. The hollow tube member is so disposed in the second portion that a space is provided between the inner wall surface of the second portion and the outer wall surface of the hollow tube member. The space is in communication with the interior of the first portion for allowing the medium to be condensed and retained during the lamp operation.

27 Claims, 4 Drawing Sheets

ELECTRODELESS LAMP HAVING A NARROW GAP BETWEEN A SEALED TUBE AND THE ARC CHAMBER SO AS TO FORM A CONSISTENT COLD SPOT

BACKGROUND OF THE INVENTION

1. Field of the Invention

The present invention relates to a high intensity discharge, lamp and more particularly to an electrodeless high intensity discharge lamp of the type having an excitation coil situated about the arc tube thereof.

2. Description of the Related Art

An electrodeless high intensity discharge lamp, which is operated by a radio frequency energy, is disclosed in U.S. Pat. No. 5,151,633. The disclosed discharge lamp has an arc tube fabricated from fused quartz, or optically transparent or translucent ceramic in which a discharge medium such as ionizable gas, mercury or sodium is filled. A coil is situated about the arc tube for causing a toroidal arc discharge in the arc tube. The discharge medium emits visible radiation upon excitation of high frequency energy supplied through the coil. The arc tube fabricated from fused quartz has a small projection formed thereon. The projection which is called as an exhaust tip has been made after exhausting impurities from the arc tube and filling the discharge medium in the arc tube through an opening provided on the arc tube. The exhaust tip is formed by partially melting the arc tube when the opening is closed or sealed. When the arc tube is fabricated from ceramic which is more heat resistive than fused quartz, a ceramic cap is required for sealing the arc tube with a suitable sealing material. The sealing material is exposed with a highly activated discharge medium and is subject to damage the seal between the arc tube and the cap.

The exhaust tip or the ceramic cap exhibits high temperature during lamp operation because of heat radiation from the arc discharge. The gaseous pressure of the medium in the arc tube is determined by the temperature of the coolest part or the cold spot of the arc tube. The cold spot of the above mentioned discharge lamp moves each time when the discharge lamp is operated and also varies in temperature, which results in undesired illuminating characteristics including color spread.

SUMMARY OF THE INVENTION

Accordingly, it is an object of the present invention to provide an improved electrodeless high intensity discharge lamp which uses a ceramic arc tube for obtaining long operating life.

It is another object of the present invention to provide an electrodeless high intensity discharge lamp which locates the cold spot of the discharge lamp at a predetermined place and with a desired temperature in order to realize excellent illuminating characteristics.

The above identified and other objects are achieved by providing an electrodeless high intensity discharge lamp of the type having an excitation coil situated thereabout. The discharge lamp has a light transmissive ceramic arc tube for containing a discharge sustaining medium and a hollow tube member having a chamber defined therein. The ceramic arc tube includes a first portion fop developing an arc discharge therein and a second portion protruding outwardly from the first portion. The hollow member is so disposed in the second portion that a space is provided between the inner wall surface of the second portion and the outer wall surface of the hollow tube member. The space is communicated with the interior (i.e., chamber) of the first portion for allowing the medium to be condensed and retained during the lamp operation.

The first portion and second portion of the arc tube are preferably elliptical and cylindrical, respectively. An ionizable fill may be contained in the hollow tube member for easily starting the discharge. The hollow tube member, which is preferably fabricated from ceramic, has a cap on one end for sealing the arc tube. At the other end of the hollow tube member there is provided a closed end, which is not located in the interior of the first portion. However it may be extended into the interior of the arc tube. The excitation coil used for developing and maintaining the arc discharge may have more than four coil turns.

BRIEF DESCRIPTION OF THE DRAWINGS

The accompanying drawings, which constitute a part of the specification, illustrate a presently preferred embodiments of the invention, and together with the general description given above and detailed description of the preferred embodiments given below, explain the principles of the present invention.

DETAILED DESCRIPTION OF THE PREFERRED EMBODIMENTS

The invention will now be explained with reference to the accompanying drawings showing embodiments thereof.

Figure 1:
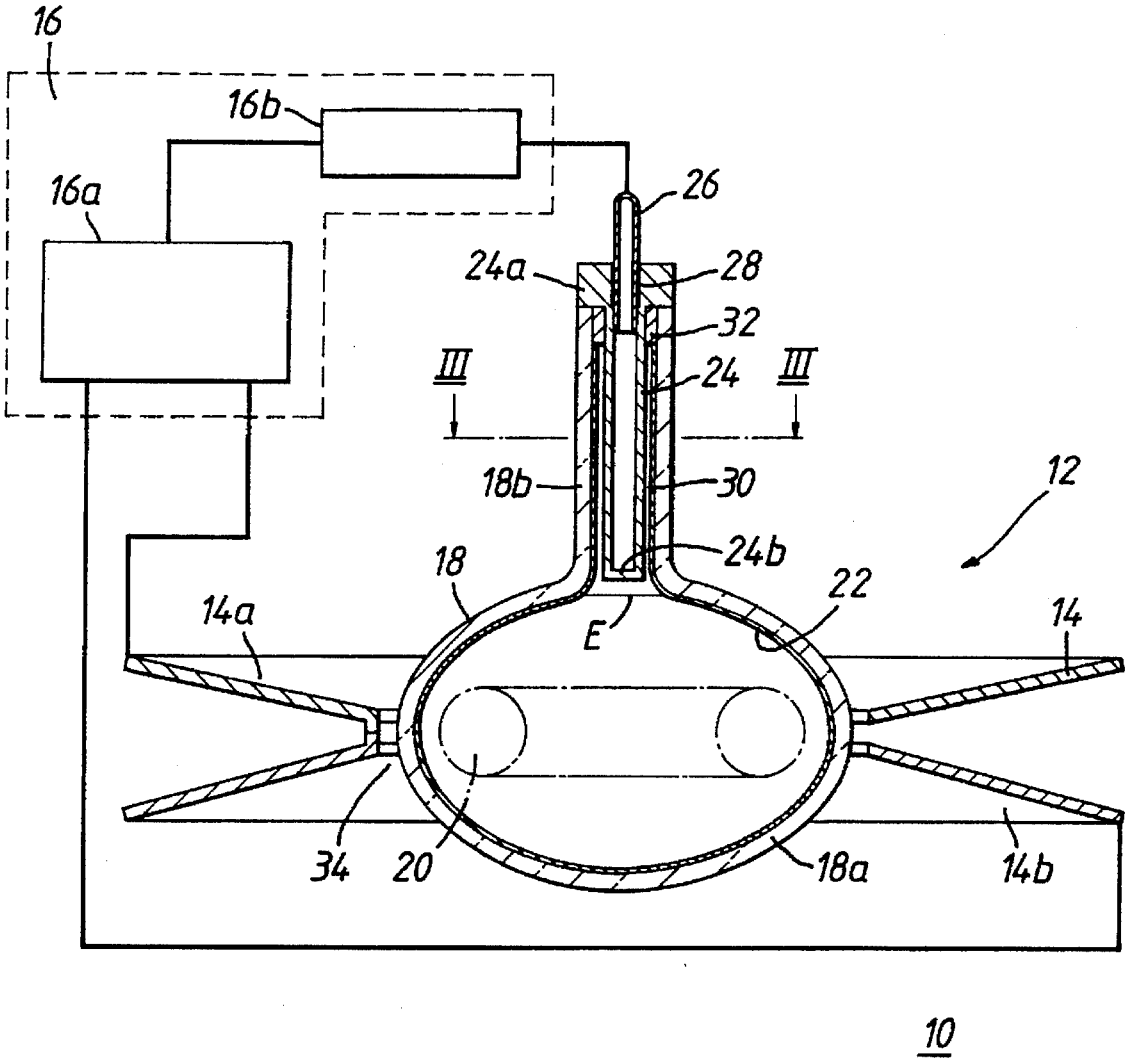
FIG. 1 is a sectional view of an electrodeless discharge lamp according to a first embodiment of the present invention.

Referring now to FIG. 1 showing a first embodiment of the present invention, an electrodeless discharge lamp 10 includes a discharge lamp tube 12, an excitation coil 14 disposed about the lamp tube 12 and a lighting circuit 16. The lighting circuit 16 has a radio frequency oscillation circuit **16*a* coupled to the excitation coil 14**.

The discharge lamp tube 12 has an arc tube 18 formed of a light transmissive ceramic material such as polycrystalline alumina. The arc tube 18 includes an elliptical portion **18*a* as a first portion and a protruding portion 18*b* as a second portion. The first portion 18*a* is not limited to an elliptical shape, however, it may be desirably shaped depending upon the application. For example the first portion 18*a* may be spherical. Each outer diameter of the elliptical portion 18*a* along the major axis and the minor axis are about 32.5 mm and about 25.0 mm, respectively. In the interior of the first portion 18*a* a toroidal shape or a ring-like shape arc discharge 20 is developed during lamp operation. The arc tube 18 contains an arc discharge sustaining medium including metal halides such as sodium iodide (NaI) and scandium iodide ($ScI_3$) for producing visible light and an inert gas for starting the lamp operation. The arc tube 18** may contain neodyium iodide ($NdI_3$), cesium iodide (CsI) and Paraseodium iodide ($PrI_3$). At least one gas selected from the group of argon, xenon and neon is used as the inert gas.

The first portion 18*a* has a metal oxide thin layer 22 coated at least on its inner surface facing closely to the arc discharge 20. The layer 22, which is formed with scandium oxide ($Sc_2O_3$) or Dysprocium oxide ($Dy_2O_3$), prevents the inner surface of the first portion 18*a* from exposure of the arc discharge 20. The lower hemisphere of the first portion 18*a* is polished for efficiently directing the light produced by the arc discharge 20 therethough.

The protruding portion or the second portion 18*b*, which is extended from the first portion 18*a*, is a cylinder. The outer diameter and the length of the the cylinder 18*b* are about 7.0 mm and 20 mm, respectively. The length of the cylinder 18*b* should be more than 5 mm for ensuring the lowest temperature or cooling spot of the discharge lamp tube 12 as explained bellow.

Figure 2:
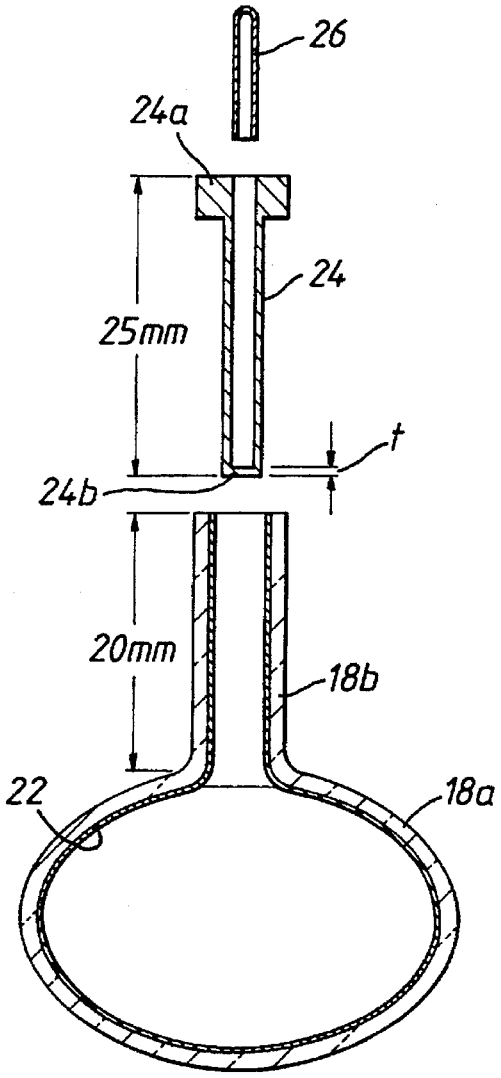
FIG. 2 is an exploded view of the electrodeless discharge lamp shown in FIG. 1.

A hollow tube member 24 is disposed in the second portion 18*b*. The outer diameter and the length of the hollow tube member 24 are set to about 4.0 mm and 25 mm, respectively. The hollow tube member 24 includes a flanged end 24*a* and a closed end 24*b* as shown in FIG. 2. The flanged end 24*a* is so placed on the top end of the second portion 18*b*. As shown in FIG. 1, the closed end 24*b* is positioned in the second portion 18*b* about 1.5 mm away from the boundary area E defined by the first portion 18*a* and the second portion 18*b*. The wall thickness t of the closed end 24*b* is preferably selected from about 0.3 mm to 2.0, mm which is smaller than that of the second portion 18*b*.

An conductive cap 26 made of niobium, copper or stainless steel is fitted to the hollow tube member 24 by means of a suitable sealing material 28, for example a glass solder containing $A1_2O_3$—$SiO_2$ or $A1_2O_3$—CaO—BaO. An ionizable gas, such as argon, xenon, krypton, neon or mixtures thereof, is filled in the hollow tube member 24 for starting the lamp operation. The gas in the hollow tube member 24 is at a relatively low pressure (13 kpa) as compared with that of rare gas filled in the arc tube 18 (33 kpa).

The conductive cap 26 is coupled to a lamp starting circuit 16*b* from which a starting voltage is applied thereto for causing the gas in the hollow tube member 24 to become conductive.

The distance d between the outer wall of the hollow tube member 24 and the inner wall of the second portion 18*b* is about 0.25 mm, which provides a space 30 communicating with the interior of the first portion 18*a*. Because the space 30 is located rather far from the interior of the first portion 18*a* the coolest part or the cold spot of the lamp 12 is produced in the space 30 during the lamp operation so that the excess discharge sustaining medium condenses in the cold spot. The dimensions of the space 30 should be designed in such a way that the condensed medium is retained in the cold spot by the capillary action. The most preferred distance in this embodiment is about 0.25 mm, however, it may be desirable if it falls within a range from 0.05 mm to 0.5 mm.

Figure 3:
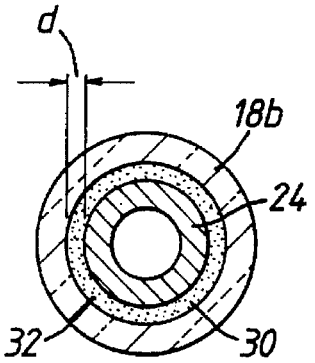
FIG. 3 is cross sectional view taken on the line III—III of FIG. 1.
Figure 6:
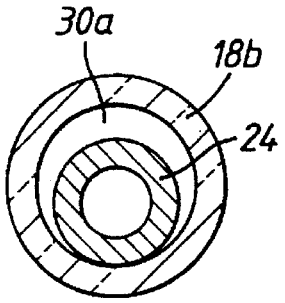
FIG. 6 and FIG. 7 are cross sectional views similar to FIG. 3 as modified embodiments of the electrodeless discharge lamp shown in FIG. 1.
Figure 7:
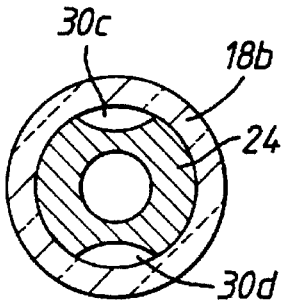

A cross-sectional view of the space 30 is not limited to a ring as shown in FIG. 3, but it may be modified to another views, for example shown in FIG. 6 and FIG. 7. The view shown in FIG. 6 is a crescent 30*a*, which is obtained by eccentrically arranging the hollow tube member 24 in the second portion 18*b*. In order to obtain two isolated small spaces 30*c*, 30*d* shown in FIG. 7, the hollow tube member 24 has two recessed grooves on its outer wall surface formed along the longitudinal axis and is tightly inserted in the second portion 18*b*.

The discharge lamp tube 12 described above is manufactured by the conventional method known to those skilled in the art and therefore detailed explanations are not provided. In this embodiment the cap 26 is utilized as an exhaust tube for exhausting impurities from the hollow tube member 24 and for filling the rare Gas in the same. One open end of the exhaust tube 26 is closed after filling the rare Gas. The hollow tube member 24 is connected to the second portion 18*b* by applying heat to the glass solder 28 disposed therebetween. Similarly the hollow tube member 24 is connected to the cap 26 with a glass solder 32. A high frequency induction heating apparatus (not shown) is used for heating the solders 28, 32 in order to connect both the second portion 18*b* and the cap 26 to the hollow tube member 24 at one time.

The excitation coil 14 has two turns which are formed by connecting two alumina disc plates 14*a*, 14*b* as shown in FIG. 1. The excitation coil 14 has a center hole 84 in which the first portion 18*a* is situated. In this embodiment, outer diameter, inner diameter and thickness of the disc plates 14*a*, 14*b* are about 62 mm, 35 mm and 2 mm, respectively. The excitation coil 14 is coupled to the radio frequency oscillation circuit (RF circuit) 16*a* for maintaining the arc discharge 20. Suitable operating frequencies are in the range from 10 MHz to 50 MHz. In this embodiment, 13.56 MHz operating frequency is generated by the RF circuit 16*a* and is supplied to the excitation coil 14.

Electric field produced by the excitation coil 14 having less than three turns is not high enough to ionize the gaseous fill in the arc tube 18 for causing or starting the discharge lamp tube 12. The hollow tube member 24 is then used as a starting aid or a starting probe in this embodiment. The conductive cap 26 is coupled to the lamp starting circuit 16*b* from which a starting voltage is applied thereto for causing the gas in the hollow tube member 24 to become conductive. Such a starting probe is not required if the excitation coil 14 has more than four coil turns although in this instance light interception by the excitation coil 14 remarkably occurs. In order to avoid the light interception, preferable coil turns are in the range from 0.3 to 1.

In the lamp operation, the starting voltage is supplied from the starting circuit 16*b* to the cap 26. At the same time RF current is supplied to the excitation coil 14 for inducing an electric field in the second portion 18*a*. The starting voltage causes a discharge in the hollow tube member 24 and the gas in the hollow tube member 24 becomes conductive. A sufficient high voltage is then capacitively coupled to the interior of the first portion 18*a* through the closed end 24*b* of the hollow tube member 24 to break down the gaseous fills contained in the arc tube 18. A toroidal arc discharge 20 is then developed in the first portion 18*a*. The thickness of the closed end 24*b* of the hollow tube member 24 in this embodiment is so selected to allow the capacitive coupling of the high voltage to the first portion 18*a*. If the closed end 24*b* of the hollow tube member 24 is thick enough to isolate the capacitive coupling to the first portion 18*a*, the electrical field developed in the hollow tube member 24 does not interact with the electrical field developed by the excitation coil 14 in the first portion 18*a*, and it is radiated outside through the walls of the hollow tube member 24 and second portion 18*b*.

The closed end 24*b* of the hollow tube member 24, which is located away from the heated arc discharge 20, has little chance to be chemically reacted with gaseous fillings. Erosion of the closed end 24b of the hollow member 24 is thus avoided. Similarly, the glass solders 28, 32 are prevented from interfering with the gaseous fillings.

Figure 4:
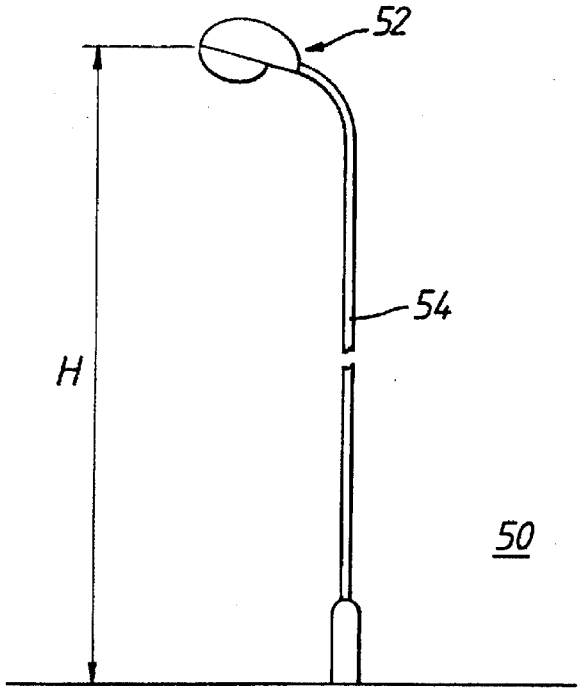
FIG. 4 is a schematic view of a street light equipped with the electrodeless discharge lamp.
Figure 5:
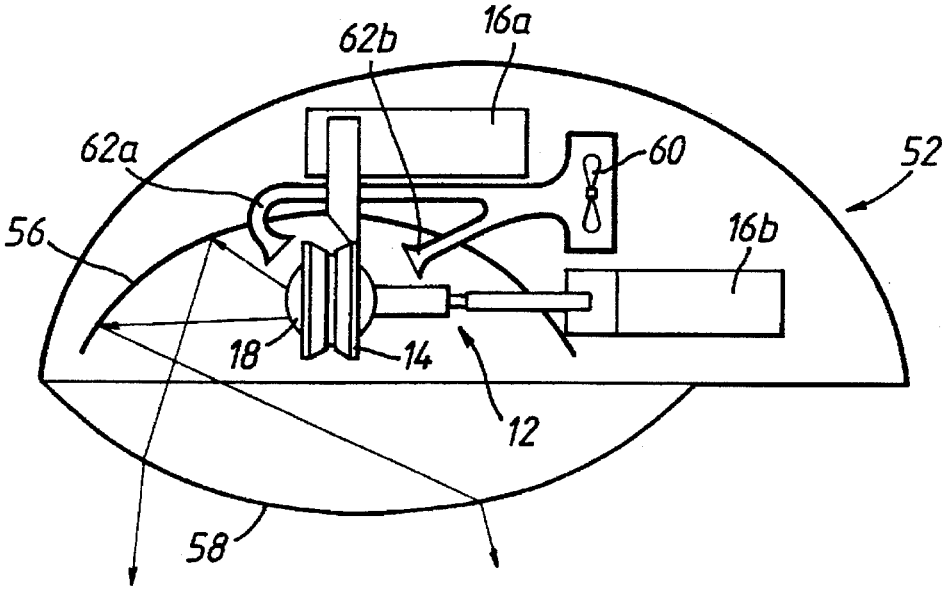
FIG.5 is a schematic view of a lighting fixture of the street light shown in FIG. 4.

FIG. 4 shows a street light 50, which employes the above described electrodeless discharge lamp 10. A lamp fixture 52 mounted on an upper end of a high mount pole 54 has a mirror 56 for reflecting light, a prism cover 58 for controlling light and the lighting circuit 16. The lamp fixture 52 has a fan 60 and air cool ducts 62a, 62b for cooling the arc tube 18. The height H of the mount pole 54 from the ground is selected to satisfy the following equation: $H=\lambda \cdot n/2$ ($\lambda$: wavelength of the RF current supplied to the excitation coil 14, n: integer) so that a high voltage induced on the mount pole 54 is avoided. In case for the lamp operated with a RF current having 13.56 MHz ($\lambda$=22.1 m), the height H is selected to 11.05 m, for example.

Figure 8:
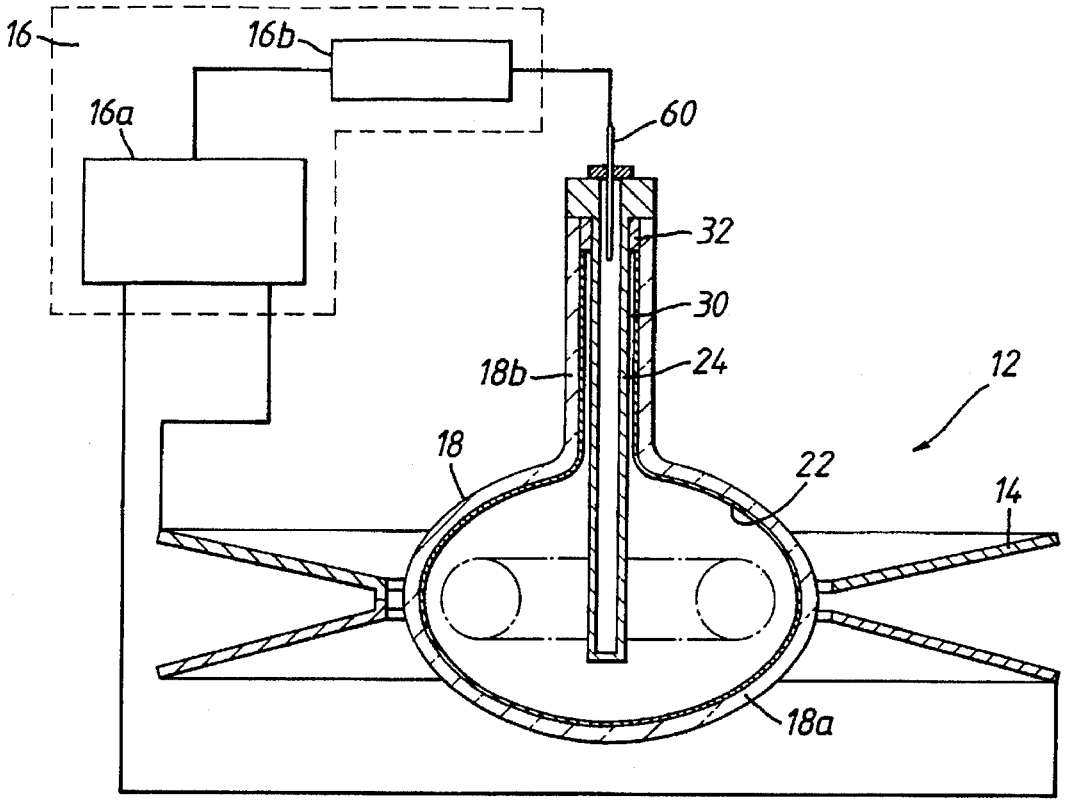
FIGS. 8 and 9 are sectional views of alternative embodiments of the electrodeless discharge lamp shown in FIG. 1.
Figure 9:
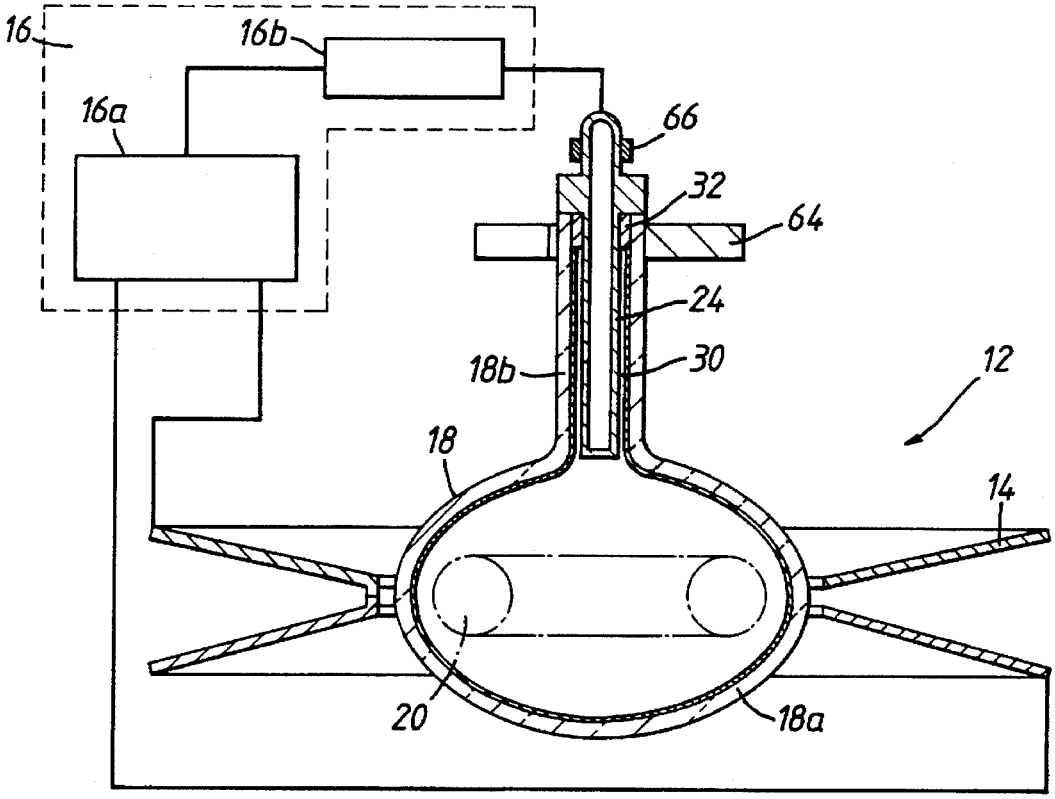

Alternative embodiments in accordance with the present invention are shown in FIGS. 8 and 9 explained hereunder where like reference characters designate identical or corresponding elements of the above-mentioned first embodiment. However, detailed explanations of those elements are not provided.

Referring now to FIG. 8 showing a first alternative embodiment, the hollow tube member 24 is extended into the interior of the first portion 18a of the arc tube 18. The extended hollow tube member 24 enhances the capacitive coupling of a sufficient high voltage to the arc tube 18 through the closed 24b end thereof to break down the gaseous fills contained in the arc tube 18. Specifically, the closed end 24b is extended beyond the center of the first portion 18a. Due to the enhanced capacitive coupling, a load on the starting circuit 16b is reduced in this embodiment. A conductive wire 60 coupled to the starting circuit 16 is used as a starting electrode 62.

FIG. 9 shows a second alternative embodiment which has a fin plate 64 attached to the protruding portion or the second portion 18b of the arc tube 18 for radiating heat. The fin 64 may be used when the discharge lamp tube 12 is fixed to the lamp fixture 52. A metal ring cap 66 for causing the glow discharge in the hollow tube member 24 is attached on the outer wall of the hollow tube member 24.

While the preferred embodiments of the present invention have been shown and described herein, many changes and modifications thereof can be carried out without departing from the scope of the general inventive concept as defined by the appended claims and their equivalents.

What is claimed is:

1. A discharge lamp for an electrodeless high intensity lamp of the type having an excitation coil situated thereabout comprising:

a light transmissive arc tube for containing a discharge sustaining medium, said arc tube including:

first portion defining a chamber for developing an arc discharge therein, the first portion having a surface with an opening formed therethrough; and a second portion protruding outwardly from the opening of the first portion; and a sealed hollow tube member received in the second portion and defining a space between the second portion of the arc tube and the hollow tube member such that the space is in communication with the chamber of the first portion.

2. A discharge lamp tube according to claim 1, wherein the space is constructed and oriented to allow the discharge sustaining medium to be condensed and retained therein during operation, such that gravity does not return the discharge sustaining medium condensed therein to the first portion during operation.

3. A discharge lamp tube according to claim 2, wherein the hollow tube member is extended into the chamber of the first portion.

4. A discharge lamp tube according to claim 2, wherein the hollow tube member contains an ionizable fill.

5. A discharge lamp tube according to claim 4 further comprising:

a starting electrode attached to the hollow tube member for exciting the ionizable fill.

6. A discharge lamp tube according to claim 2, wherein the first portion is elliptical formed and the second portion is cylindrically formed.

7. A discharge lamp tube according to claim 2, wherein the space between the second portion and the hollow tube member is varied along the circumferential direction of the second portion.

8. A discharge lamp tube for an electrodeless high intensity discharge lamp of the type having an excitation coil situated thereabout comprising:

an arc tube for containing discharge sustaining medium, said arc tube including:

an elliptical portion defining a chamber for developing an arc discharge therein, the elliptical portion having a surface with an opening formed therethrough; and a cylindrical portion protruding outwardly from the elliptical portion, the cylindrical portion including a first end engaged to the opening of the elliptical portion, and a second end; and a non-metal hollow tube member for containing an ionizable fill, the hollow tube member being received in the cylindrical portion of the arc tube to define a space between the hollow tube member and the cylindrical portion such that the space is in communication with the chamber of the elliptical portion, the hollow tube member having a flanged end that engages the second end of the cylindrical portion and a closed end.

9. A discharge lamp tube according to claim 8 further comprising:

a starting electrode attached to the hollow tube member for exciting the ionizable fill.

10. A discharge lamp tube according to claim 9, wherein the closed end is not disposed within the chamber of the elliptical portion.

11. An electrodeless high intensity discharge lamp comprising:

an arc tube for containing a discharge sustaining fill, the arc tube including:

a first portion having a chamber defined therein for developing an arc discharge therein, the first portion having a surface with an opening formed therethrough; and a second portion protruding outwardly from the opening of the first portion;

a hollow tube member received in the second portion and defining a space between the hollow tube member and the second portion such that the space is in communication with the chamber of the first portion;

an excitation means for developing the arc discharge in the first portion; and means for applying a high frequency energy to the excitation means.

12. An electrodeless high intensity discharge lamp according to claim 11, wherein the excitation means includes a coil member situated about the first portion.

13. An electrodeless high intensity discharge lamp according to claim 12, wherein the coil member has more than four turns.

14. An electrodeless high intensity discharge lamp according to claim 12, wherein the coil member has less than three turns.

15. An electrodeless high intensity discharge lamp according to claim 14, wherein the hollow tube member contains an ionizable fill.

16. An electrodeless high intensity discharge lamp according to claim 15 further comprising a starting electrode attached to the hollow tube member and starting means for applying energy for exciting the ionizable fill in the hollow tube member.

17. An illuminating device comprising:

an electrodeless high intensity discharge lamp comprising:

an arc tube for containing a discharge sustaining fill and having a first portion for developing an arc discharge therein and a second portion, the first portion defining a chamber therein and having a surface with an opening formed therethrough, the second portion projecting outwardly from the opening of the first portion, and a hollow tube member received in the second portion to thereby define a space between the second portion and the hollow member, the space being in communication with the chamber of the first portion;

a lighting circuit including an excitation means for developing the arc discharge in the first portion, the excitation means being situated about the first portion; and a lamp fixture for mounting the discharge lamp and the lighting circuit.

18. An illuminating device according to claim 17, wherein the hollow tube member contains an ionizable fill.

19. An illuminating device according to claim 18, wherein the lighting circuit includes a starting circuit for applying energy for exciting the ionizable fill in the hollow tube member.

20. A discharge lamp tube according to claim 1, wherein the arc tube is ceramic.

21. A discharge lamp tube according to claim 8, wherein the arc tube is ceramic.

22. An electrodeless high intensity discharge lamp according to claim 11, wherein the arc tube is ceramic.

23. An illuminating device according to claim 17, wherein the arc tube is ceramic.

24. A discharge lamp tube according to claim 1, wherein the sealed hollow tube member defines a chamber therein that is not in communication with the chamber of the first portion of the arc tube.

25. A discharge lamp tube according to claim 8, wherein the hollow tube member defines a chamber therein that is not in communication with the chamber of the elliptical portion of the arc tube.

26. An electrodeless high intensity discharge lamp according to claim 11, wherein the hollow tube member defines a chamber therein that is not in communication with the chamber of the first portion of the arc tube.

27. An illuminating device according to claim 17, wherein the sealed hollow tube member defines a chamber therein that is not in communication with the chamber of the first portion of the arc tube.

* * * * *